US006035876A

United States Patent [19]

Stover et al.

[11] Patent Number: 6,035,876

[45] Date of Patent: Mar. 14, 2000

[54] FREE-STANDING CEILING

[75] Inventors: David R. Stover, Evanston; Merritt W. Seymour, Chicago; Robert J. Surra, Wheaton; Alan C. Wendt, Barrington, all of Ill.; Merle Lindby-Young, Bartonville, Tex.

[73] Assignee: USG Interiors, Inc., Chicago, Ill.

[21] Appl. No.: 08/808,653

[22] Filed: Feb. 28, 1997

[51] Int. Cl.[7] ..... E04H 15/28

[52] U.S. Cl. ..... 135/98; 135/91; 135/99

[58] Field of Search ..... 135/97, 20.1, 21, 135/98, 99, 91; 52/73, 74

[56] References Cited

U.S. PATENT DOCUMENTS

| | | | |
|---|---|---|---|
| 284,846 | 9/1883 | Herron . | |
| D. 370,556 | 6/1996 | Yu | D3/5 |
| D. 371,902 | 7/1996 | Lee | D3/5 |
| 1,934,569 | 11/1933 | Stuttgen . | |
| 3,464,431 | 9/1969 | Loeffler . | |
| 3,853,418 | 12/1974 | Druin et al. | 404/1 |
| 3,949,962 | 4/1976 | Wilson | 249/18 |
| 4,274,429 | 6/1981 | Kinski . | |
| 4,677,796 | 7/1987 | Mellott | 52/73 |
| 4,766,919 | 8/1988 | Crates . | |
| 4,813,442 | 3/1989 | Haines | 135/98 |
| 5,116,258 | 5/1992 | Vennik . | |
| 5,263,505 | 11/1993 | Yeom . | |
| 5,273,062 | 12/1993 | Mozdzanowski | 135/16 |
| 5,323,798 | 6/1994 | Yang | 135/910 X |
| 5,441,068 | 8/1995 | Rasch et al. | 135/98 |
| 5,449,012 | 9/1995 | Friedman | 135/16 |
| 5,611,614 | 3/1997 | Morgan | 135/910 X |

*Primary Examiner*—Beth Aubrey
*Attorney, Agent, or Firm*—Lee, Mann, Smith, McWilliams, Sweeney & Ohlson

[57] ABSTRACT

A free-standing ceiling structure including an elongate column member having a bottom end and a top end. A plurality of primary arms are attached to the column member and extend radially therefrom. Each primary arm includes first and second sub-arms extending outwardly therefrom. A pair of peripheral panel members are respectively attached to and supported by a primary arm and by the sub-arms attached to the primary arm. A plurality of central canopy members are attached to and supported by the primary arms. A plurality of secondary arms extend radially from the column member and are located below the primary arms. The outer end of each secondary arm includes a light fixture. The column member includes one or more utility devices for providing environmental control and communication services.

20 Claims, 13 Drawing Sheets

FREE-STANDING CEILING

BACKGROUND OF THE INVENTION

The present invention is directed to a free-standing ceiling for use within an interior or exterior space, and in particular to a free-standing ceiling that emulates some attributes of a natural tree and that provides environmental control, electrical utilities and communication utilities.

Many interior spaces of rooms and buildings, and in particular spaces that have large open areas, provide an uninviting cold and sterile atmosphere. Many exterior spaces of buildings and other structures, such as patios and courtyards, also provide large open spaces that are uninviting. Various types of furniture systems and light fixtures have been used in the past to try and provide a natural, human scale, comfortable and friendly environment in such spaces. However, none of the prior solutions to such uninviting spaces have provided a free-standing ceiling that incorporates utilities for controlling the acoustics, lighting, glare and temperature of the space, and that also provide electrical, data and communication interfaces.

SUMMARY OF THE INVENTION

The free-standing ceiling structure includes an elongate column member having a bottom end and a top end and a central longitudinal axis. The column member extends vertically upward from a support surface. A plurality of primary arms are supported by the column member. Each primary arm includes a proximal end rigidly affixed to the column member and extends radially from the column member to a distal end. A respective first sub-arm is attached to each primary arm. A respective second sub-arm is also attached to each primary arm. One or more peripheral panel members are attached to and supported by each primary arm and by the first and second sub-arms attached to the primary arm. A plurality of canopy members are attached to and supported by the primary arms. Each canopy member overlaps with at least one of the peripheral panel members such that the peripheral panel member projects outwardly beyond the canopy member. A plurality of secondary arms are attached to the column member below the primary arms. Each secondary arm extends radially from the column member to a distal end. Fixtures for lighting or sign age can be attached to the distal end of each secondary arm. The column member includes a plurality of elongate cap retainers that extend along the longitudinal length of the column member and that are located around the perimeter of the column. A plurality of removable cap members are selectively attached to the cap retainers. One or more utility devices can be attached to the cap retainers for use by an individual.

BRIEF DESCRIPTION OF THE DRAWING FIGURES

DETAILED DESCRIPTION OF THE PREFERRED EMBODIMENT

Figure 1:
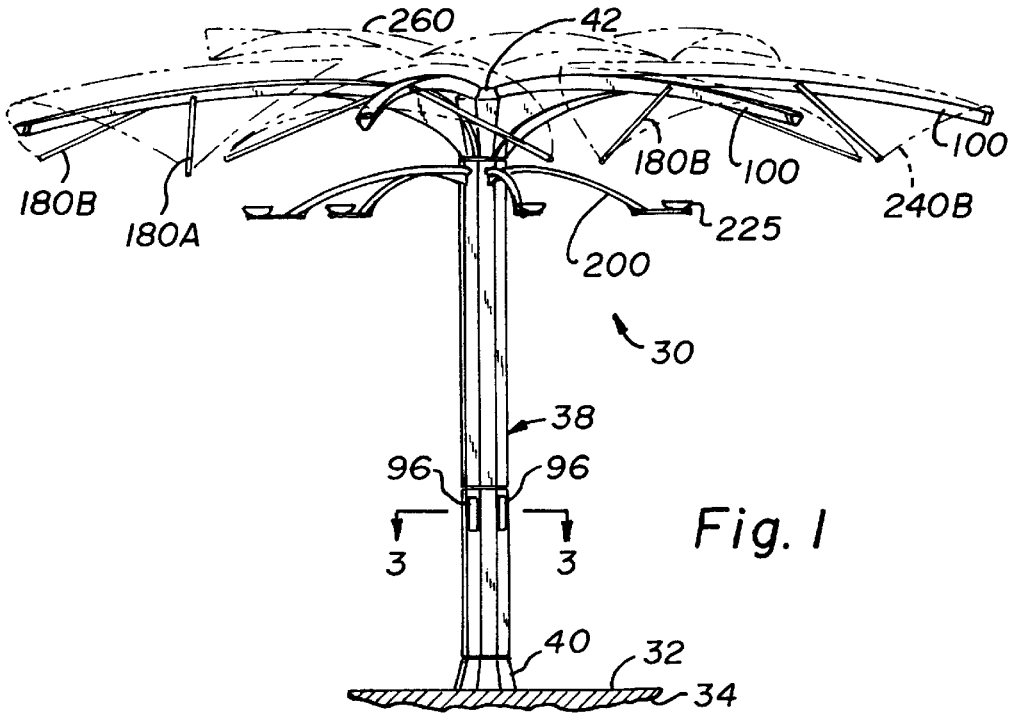
FIG. 1 is a side elevational view of the free-standing ceiling structure of the present invention with the peripheral panel members and the canopy members shown in phantom lines.
Figure 3:
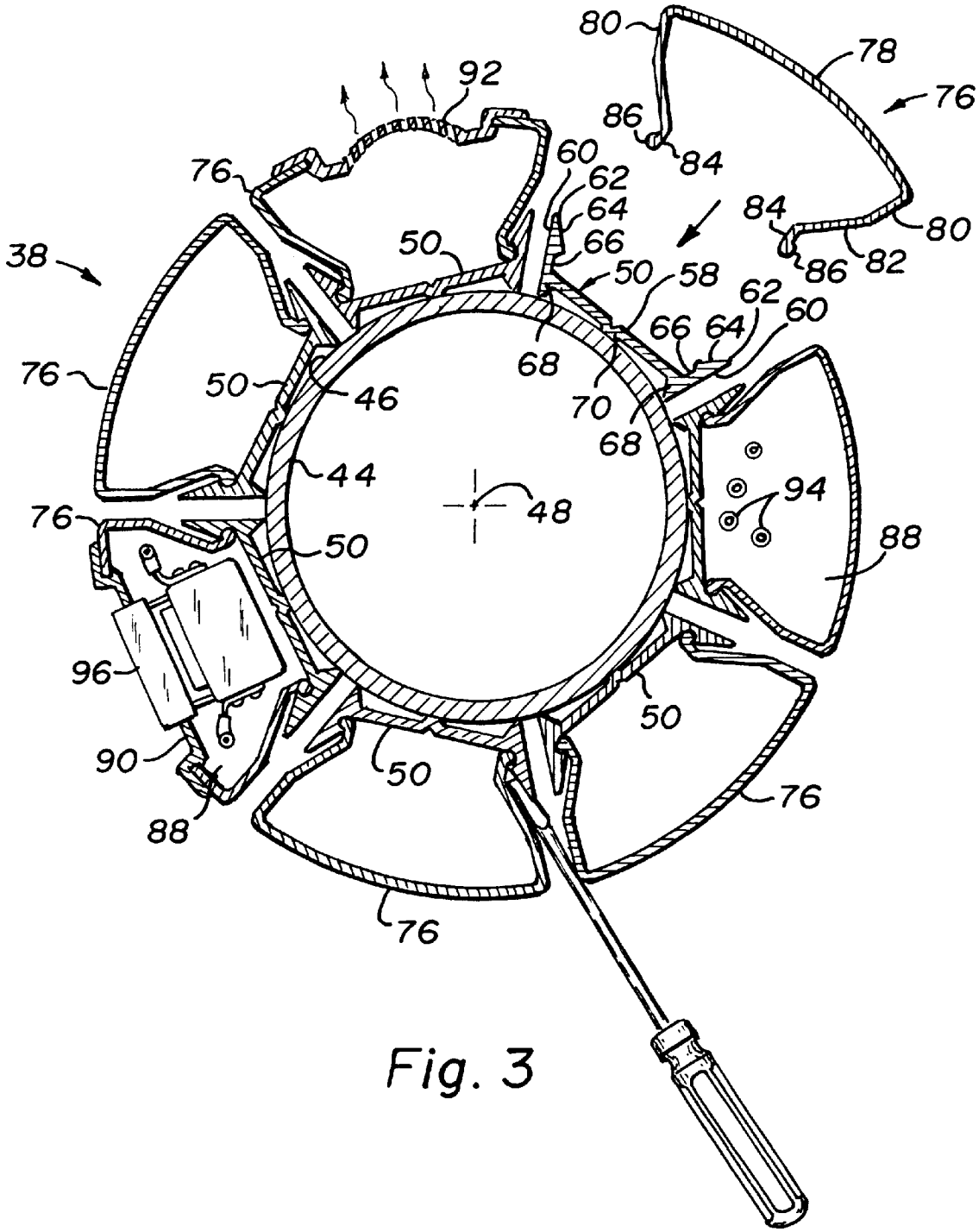
FIG. 3 is a cross-sectional view of the column member taken along lines 3—3 of FIG. 1.

FIG. 1 shows the free-standing ceiling structure 30 of the present invention supported solely by a support surface 32 of a floor 34. The ceiling structure 30 includes a vertical supporting structure such as an elongate column member 38 having a bottom end 40 and a top end 42. As best shown in FIG. 3, the column member 38 includes an elongate circular and tubular support member 44 having a generally cylindrical outer surface 46 that extends around the perimeter of the wall of the support member 44. The support member 44 extends between the bottom end 40 and the top end 42 along a central longitudinal axis 48. The support member 44 can be formed in other shapes if desired, such as square or rectangular shapes and may be solid as opposed to tubular. The support member 44 is preferably formed from steel.

Figure 12:
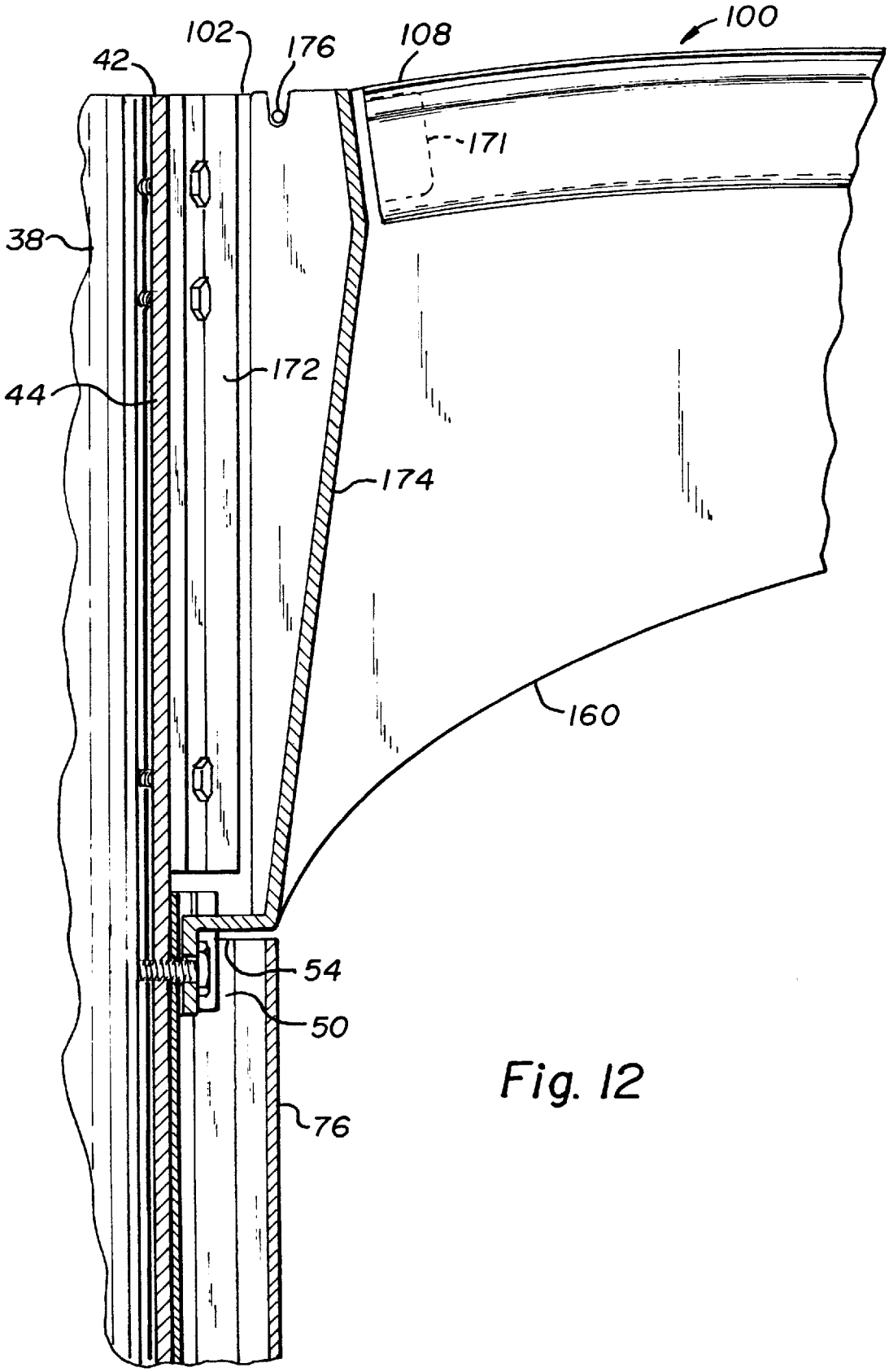
FIG. 12 is a partial cross-sectional elevational view showing the connection of a primary arm to the column member.
Figure 20:
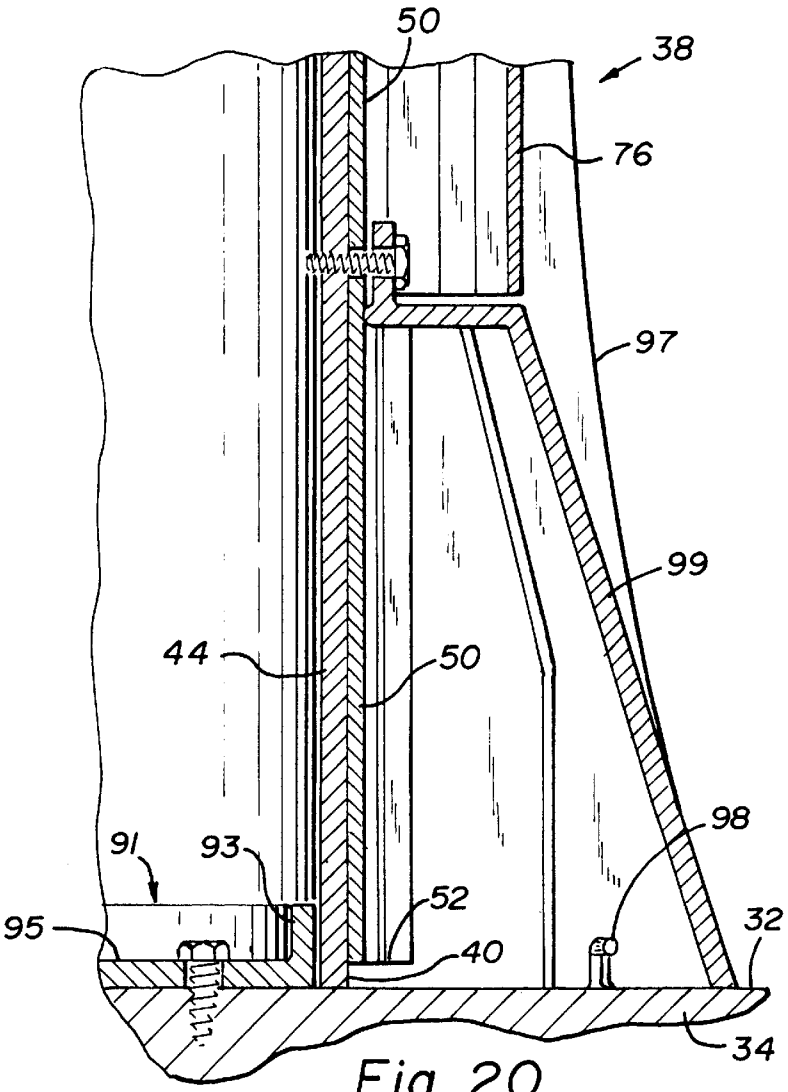
FIG. 20 is a cross-sectional view taken along lines 20—20 of FIG. 19.

The column member 38 includes a plurality of elongate cap retainers 50 as best shown in FIG. 3. The cap retainers 50 extend longitudinally along the length of the support member 44 from a bottom end 52, as shown in FIG. 20, that is located adjacent the bottom end 40 of the support member 44, to a top end 54 as shown in FIG. 12 that is spaced apart from the top end 42 of the support member 44. Two or more cap retainers 50 may be placed end to end in longitudinal alignment with one another to span the distance from the bottom end 52 to the top end 54. The cap retainers 50 are attached to the outer surface 46 of the support member 44 by mechanical fasteners, welding or other attachment means. The cap retainers 50 are located circumferentially around the outer surface 46 of the support member 44 and about the central axis 48.

As best shown in FIG. 3, each cap retainer 50 includes a web 58 that extends between two spaced apart flanges 60. Each flange 60 extends from the web 58 in a generally radial direction relative to the central axis 48. Each flange 60 includes a tip 62 and a sloped ramp 64 that forms an elongate notch 66 with the web 58. Each cap retainer 50 also includes an elongate foot 68 that extends along each edge of the web 58 on the side of the web 58 opposite the flanges 60. The feet 68 extend outwardly from the web 58 to engage the support member 44. The web 58 also includes an elongate ridge 70 that extends parallel to the flanges 60 and that is located on the internal surface of the web 58. The ridge 70 extends outwardly from the web 58 to engage the support member 44. A mechanical fastener is inserted through the ridge 70 to fasten the cap retainer 50 to the support member 44. The cap retainers 50 are preferably formed as an extrusion of aluminum.

The column member 38 also includes a plurality of cap members 76. Each cap member 76 is selectively attachable to and removable from a respective cap retainer 50. Each cap member 76 includes an outer wall 78 that is elongate in the longitudinal direction of the column member 38 and two opposing side walls 80 located on respective sides of the outer wall 78. Each side wall 80 includes an angled portion 82 that is configured to extend generally parallel to the ramp 64 of the flanges 60 of the cap retainer 50. The free edge 84 of each side wall 80 includes an elongate rib 86. Each rib 86 is configured to intermit with a notch 66 in a retainer member 50. The free edges 84 of the opposing side walls 80 may be flexed inwardly towards one another. The cap members 76 are preferably formed as an extrusion of aluminum.

A cap member 76 is snap-fit to a cap retainer 50 by pressing the cap member 76 radially inwardly towards the retainer member 50 such that the edges 84 of the side walls 80 slide downwardly and inwardly along the ramps 64 of the retainer member 50 until the ribs 86 snap into the notches 66. The notches 66 selectively retain the ribs 86 such that the cap member 76 is selectively attached to the cap retainer 50. The cap member 76 may be selectively removed from the cap retainer 50 by pressing the edge 84 of one of the side walls 80 inwardly, such as with the use of a screwdriver or other implement as shown in FIG. 3. An assembled cap member 76 and cap retainer 50 form an elongate channel 88 therebetween. Two or more cap members 76 may be snap-fit to one cap retainer 50 in an end-to-end relationship.

As shown in FIG. 3, the outer wall 78 of a cap member 76 may include an aperture 90, or a plurality of perforations or slots 92. One or more conduits 94 such as electrical, communication, coaxial or fiber-optic cables, pipes for water, or ducts for air flow, may be located within a channel 88. One or more utility devices 96 may be located within the channel 88 of a cap member 76 and attached to a cap retainer 50. The utility device 96 may comprise air vents, liquid dispensing mechanisms, electrical receptacles, data ports, microphones, speaker systems, telephones, video displays, fans, keypad and various other environmental control and communication devices. Access to the utility device 96 is provided through a port or aperture 90 in the cap member 76. Alternatively, one cap member 76 may extend above the utility device 96 and another cap member 76 may extend below the utility device 96. As shown in FIG. 1, the utility devices 96 are located at a height above the support surface 32 of the floor 34 such that they may be easily operated or used by an individual.

Figure 19:
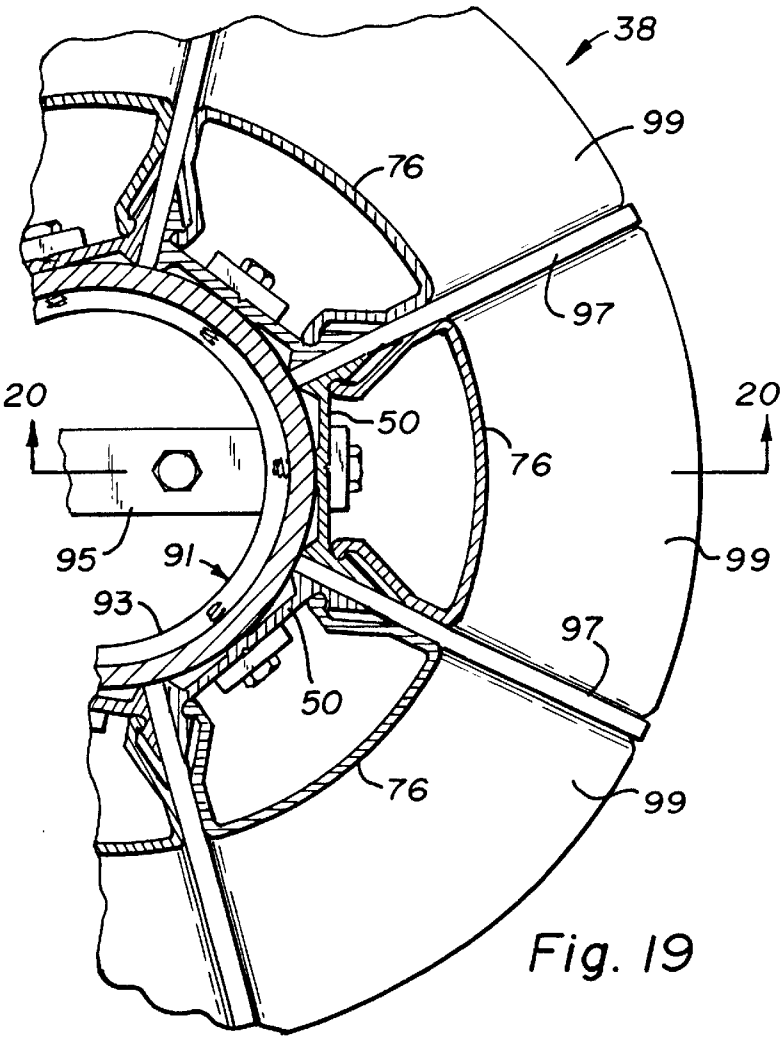
FIG. 19 is a partial cross-sectional plan view of the base of the column member.

As best shown in FIGS. 19 and 20, the bottom end 40 of the support member 44 is attached to a base member 91 that is secured to the floor 34. The base member 91 includes a circular ring 93 and a diametrically extending bar 95. The base of the column member 38 also includes a plurality of radially extending fins 97 that are attached to the support member 44 by clamping between cap retainers 50. Each fin 97 includes a pin 98 projecting from each side thereof. A plurality of base caps 99 are attached to the column member 38. Each base cap 99 is located between an adjacent pair of fins 97 and is attached to the fins by the pins 98.

Figure 4:
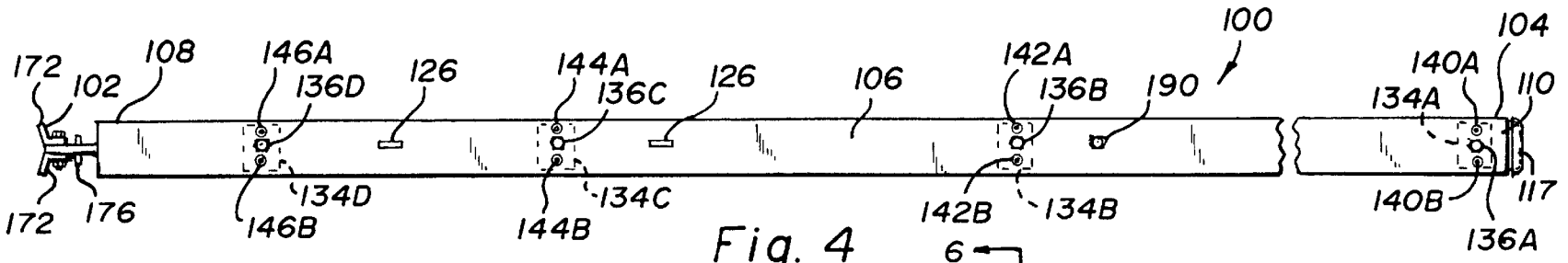
FIG. 4 is a top plan view a primary arm.
Figure 5:
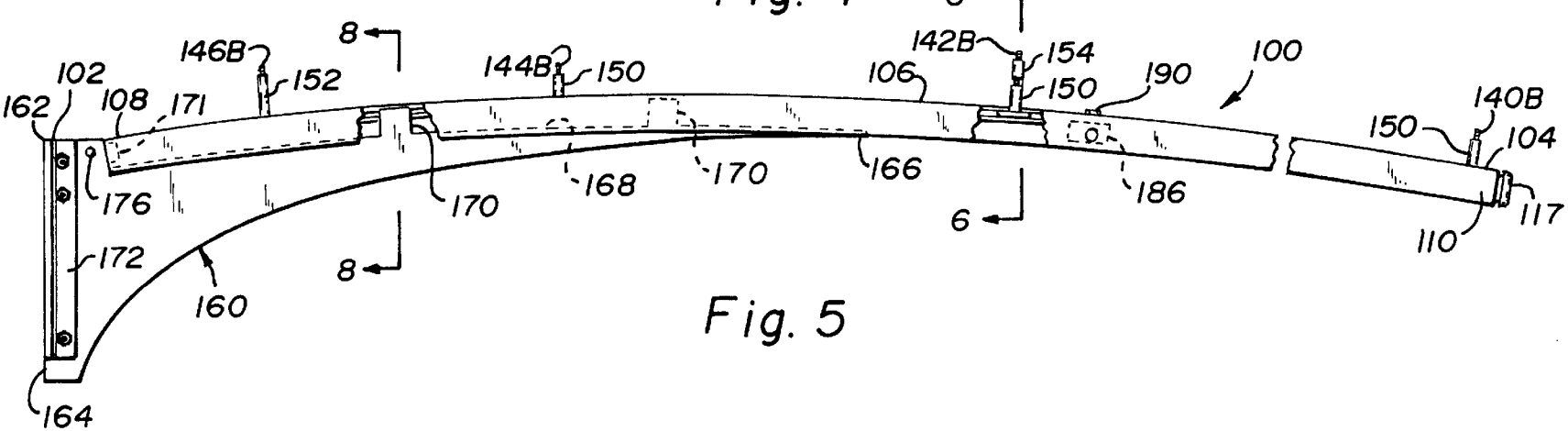
FIG. 5 is a side elevational view of the primary arm of FIG. 4.
Figure 6:
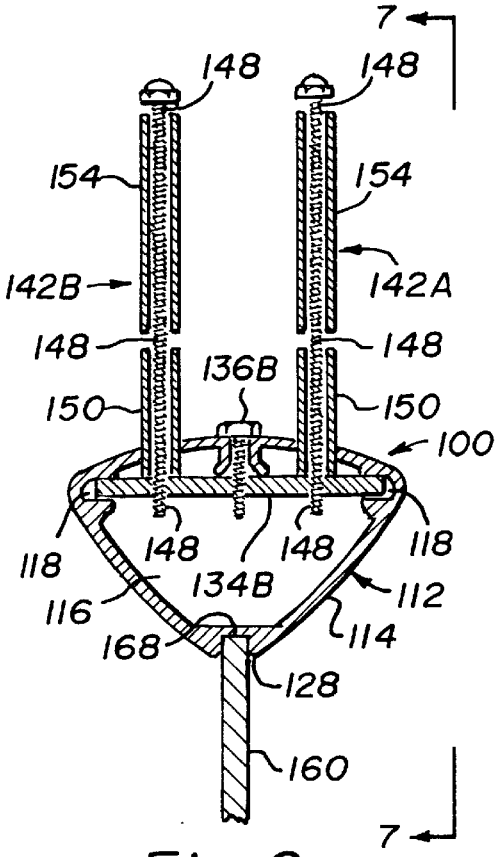
FIG. 6 is a cross-sectional view taken along lines 6—6 of FIG. 5.
Figure 7:
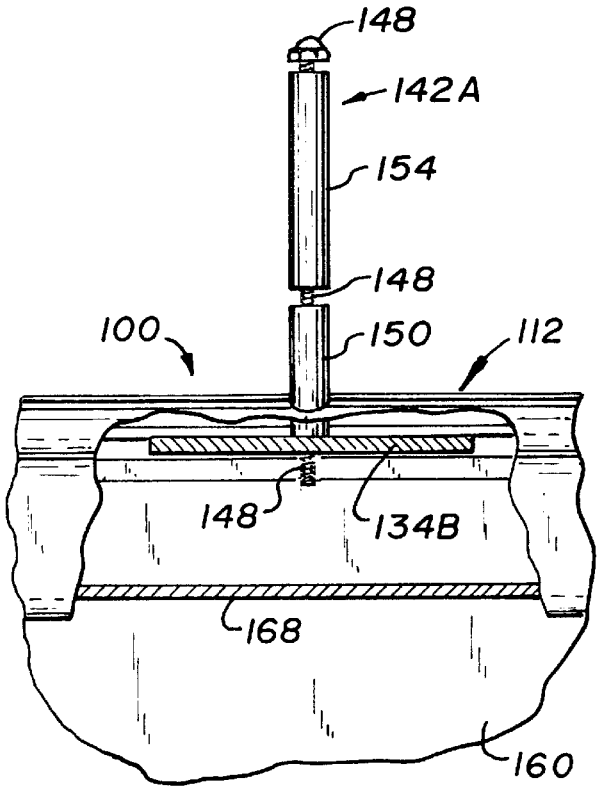
FIG. 7 is a cut-away side elevational view of a portion of a primary arm taken along lines 7—7 of FIG. 6.
Figure 8:
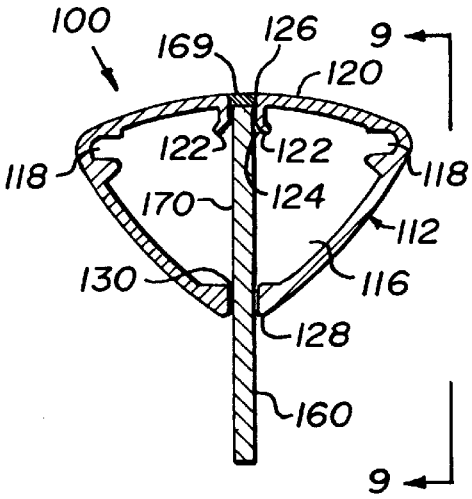
FIG. 8 is a cross-sectional view taken along lines 8—8 of FIG. 5.
Figure 9:
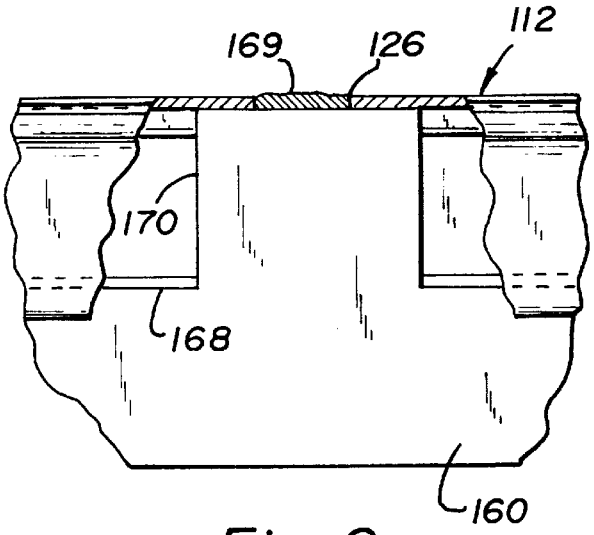
FIG. 9 is a cut-away side elevational view of a portion of a primary arm taken along lines 9—9 of FIG. 8.

The ceiling structure 30 includes a plurality of primary arms 100. As best shown in FIGS. 4 and 5, each primary arm 100 includes a proximal end 102 and a distal end 104. The primary arm 100 includes an elongate support member 106 having a first end 108 and a second end 110. The support member 106 includes a housing 112 as best shown in FIGS. 6 and 8. The housing 112 includes a peripheral wall 114 forming a chamber 116 therein. A cap 117 is attached to the second end 110 of the support member to enclose the chamber 116. The peripheral wall 114 forms opposing elongate channels 118 within the chamber 116. The peripheral wall 114 includes a top wall portion 120 that extends between the opposing channels 118. A pair of spaced apart ribs 122 extend longitudinally along the top wall portion 120 and extend downwardly therefrom in the interior of the chamber 116. The ribs 122 are located generally midway between the opposing channels 118 and form an elongate channel 124 therebetween. A plurality of slots 126 extend through the top wall portion 120 of the housing 112. An external elongate channel 128 is formed in the peripheral wall 114 at the bottom of the housing 112. The channel 128 includes a plurality of slots 130, wherein each slot 130 is generally vertically aligned with a corresponding slot 126. The support member 106 is formed as an extrusion of aluminum.

Each primary arm 100 includes a plurality of mounting plates 134A–D. As shown in FIG. 6, the mounting plate 134B is located within the chamber 116 of the housing 112 and extends from within the left channel 118 to within the right channel 118. A mechanical fastener 136B extends through the top wall portion 120 and the channel 124 to th readably engage the plate 134B. The fastener 136B secures the plate 134B against the ribs 122 and within the channels 118. Each of the remaining mounting plates 134A, C and D are mounted to the housing 112 in a similar fashion.

Each primary arm 100 includes a plurality of stanchions. Stanchions 140A–B are attached to the mounting plate 134A on transversely opposing sides of the fastener 136A and extend upwardly through the top wall portion 120. Stanchions 142A–B are attached to the mounting plate 134B on transversely opposing sides of the fastener 136B and extend upwardly through the top wall portion 120 as shown in FIG. 6. Stanchions 144A–B are attached to the mounting plate 134C on transversely opposing sides of the fastener 136C and extend vertically upwardly through the upper wall portion 120. Stanchions 146A–B are attached to the mounting plate 134D on transversely opposing sides of the fastener 136D and extend upwardly through the top wall portion 120.

Each of the stanchions includes a threaded fastener 148 having a head, such as a separate acorn nut, and a shank that is th readably attached to a mounting plate. The stanchions 140A–B, 142A–B and 144A–B each include a tubular sleeve 150 that extends around the fastener 148. The sleeves 150 have a uniform first length. Each of the stanchions 146A–B include a tubular sleeve 152. Each sleeve 152 has a second length that is greater than the first length of the sleeves 150. As shown in FIG. 6, each of the stanchions 142A–B respectively includes a second sleeve 154 that is located above the sleeve 150.

Each primary arm 100 also includes a gusset member 160 that rigidly engages the support member 106. The gusset member 160 includes a first end 162 having an elongate edge 164 and a second end 166. The gusset member 160 tapers from the elongate edge 164 at the first end 162 to a tip at the second end 166. The gusset member 160 includes a top edge 168 that extends from adjacent the first end 162 to the second end 166. As shown in FIGS. 5 and 6, the top edge 168 is located within the channel 128 of the housing 112. The gusset member 160 includes a plurality of tabs 170 as shown in FIGS. 5 and 8, that respectively extend through the slots 126 in the housing 112 with the top edge of each tab 170 being located within the channel 124 of the housing 112. The tabs 170 are secured by welds 169 within the slots 126 to the housing 112. An angle 172 is attached to each side of the gusset member 160 at the first end 162. The gusset member 160 also includes a tab 171 that is inserted into the chamber 116 of the housing 112 through the first end 108 of the support member 106. The gusset member 160 and the angles 172 are preferably formed from aluminum.

Figure 2:
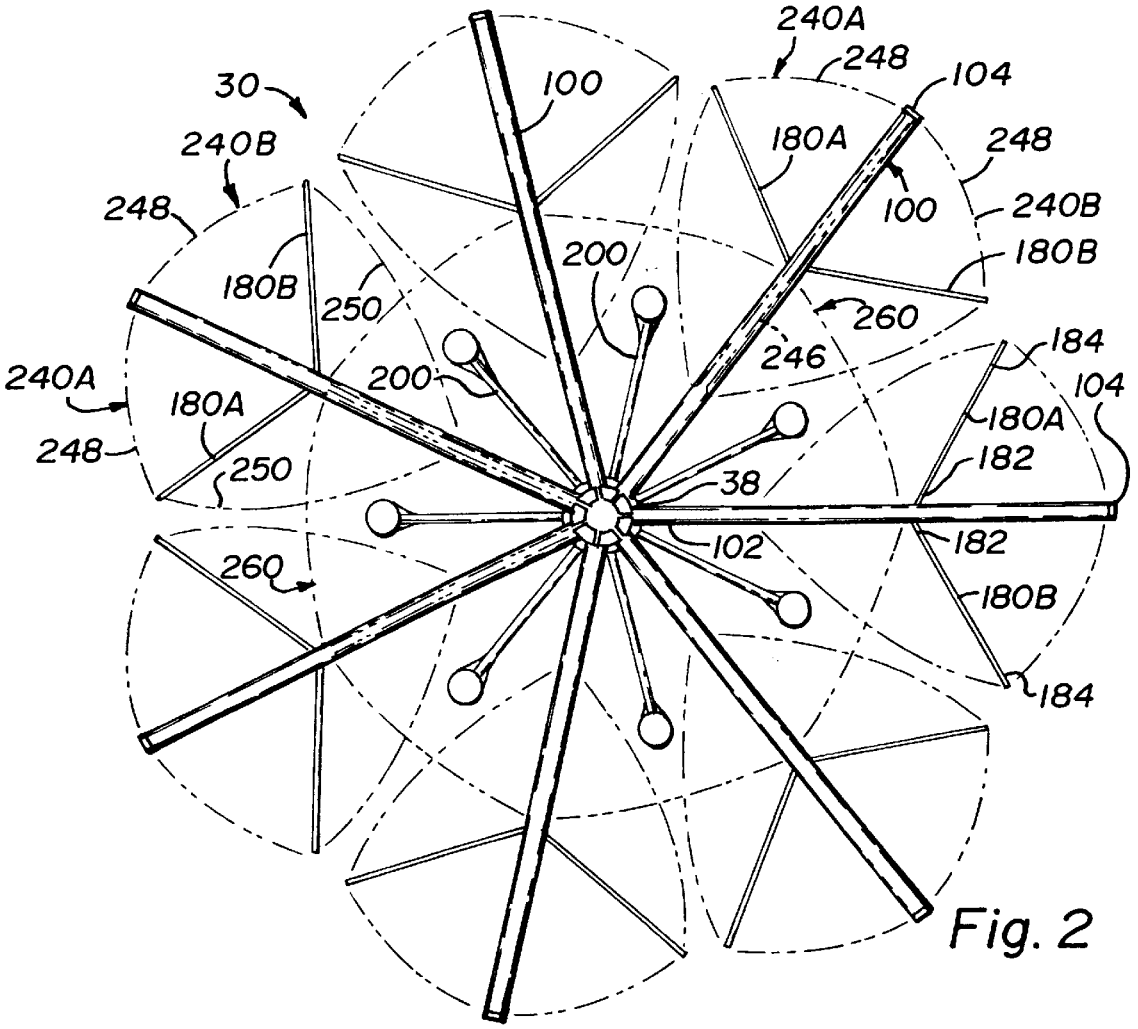
FIG. 2 is a top plan view of the free-standing ceiling structure with the peripheral panel members and the central canopy members shown in phantom lines.
Figure 10:
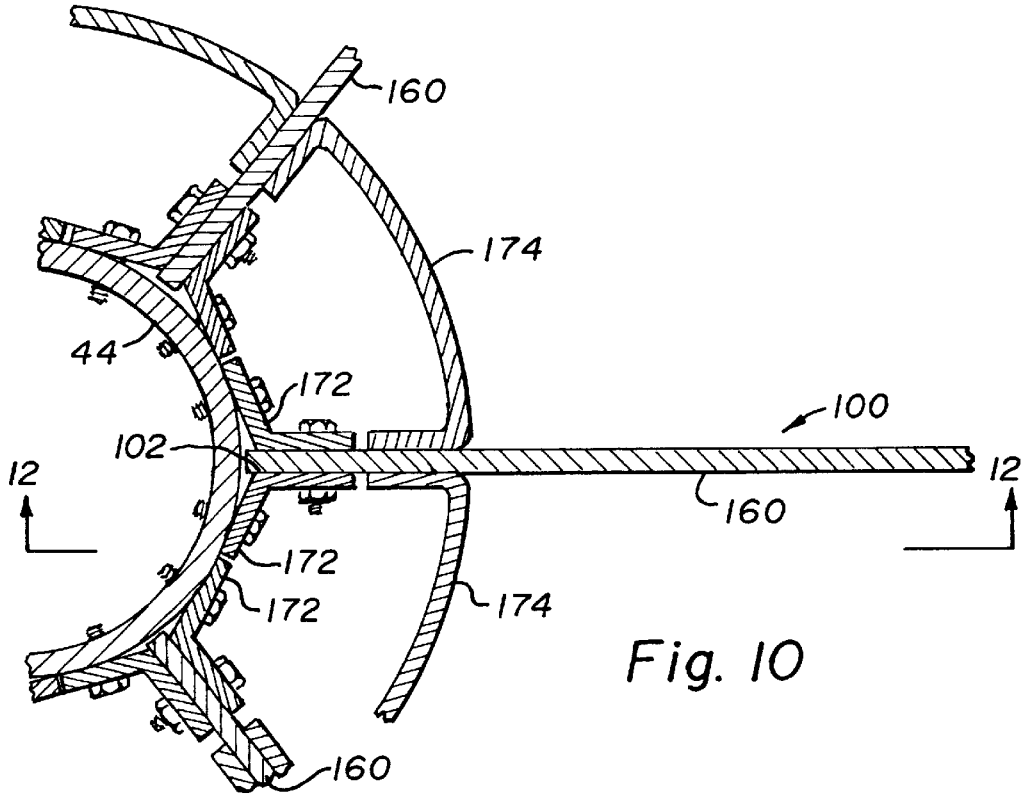
FIG. 10 is a partial cross-sectional plan view showing the connection of primary arms to the column member.

As shown in FIGS. 2, 10 and 12, the proximal end 102 of each primary arm 100 is attached to the column member 38. The angles 172 of each primary arm 100 are connected to the support member 44 of the column member 38. Each primary arm 100 extends generally radially from the column member 38. The primary arms 100 are equally spaced from one another around the perimeter of the support member 44. A hub cover 174 is located between each adjacent pair of primary arms 100. The hub covers 174 are adapted to enclose and hide the angles 172 of the primary arms 100. The bottom end of each hub cover 174 is fastened to the support member 44 and the top end of the hub cover 174 is held in position by a pin 176 projecting from each side of the gusset member 160.

Figure 17:
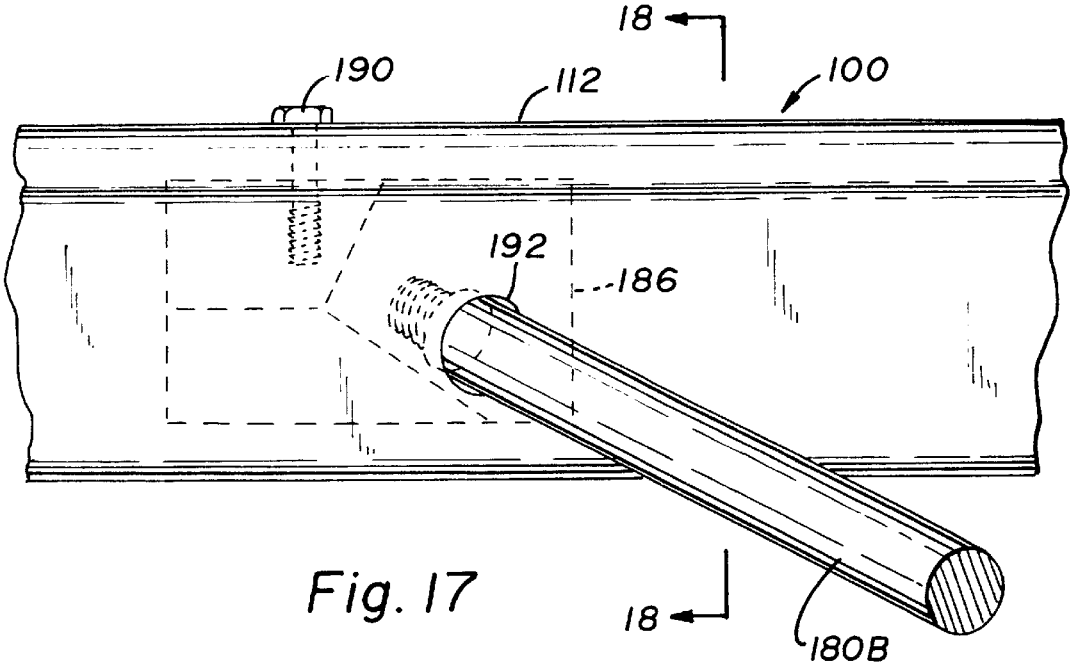
FIG. 17 is a partial side elevational view of a primary arm and of a sub-arm.
Figure 18:
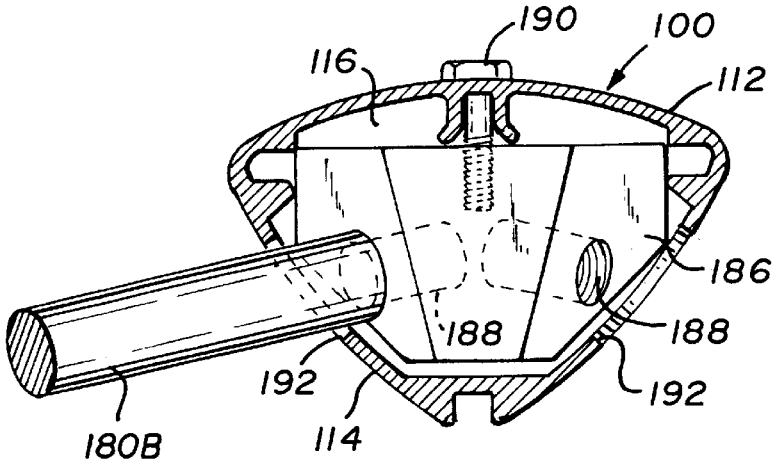
FIG. 18 is a cross-sectional view taken along lines 18—18 of FIG. 17.

As best shown in FIG. 2, each primary arm 100 includes a first sub-arm 180A and a second sub-arm 180B. Each sub-arm 180A–B includes a first end 182 and a second end 184. The first end 182 of each sub-arm 180A–B is externally threaded and the second end 184 includes an internally threaded bore. As shown in FIGS. 17 and 18, the primary arm 100 includes an attachment member 186 located within the chamber 116 of the housing 112. The attachment member 186 includes a pair of threaded bores 188. The attachment member 186 is held stationarily in position within the housing 112 by a fastener 190. Each sub-arm 180A–B extends through an aperture 192 located in the peripheral wall 114 of the housing 112 such that the first end 182 thereof is th readably inserted into the bore 188 for attachment to the attachment member 186. The sub-arms 180A and B are respectively located on opposite sides of the primary arm 100. As viewed in plan in FIG. 2, each sub-arm 180A–B extends outwardly from the primary arm at an angle of approximately 65°.

Figure 14:
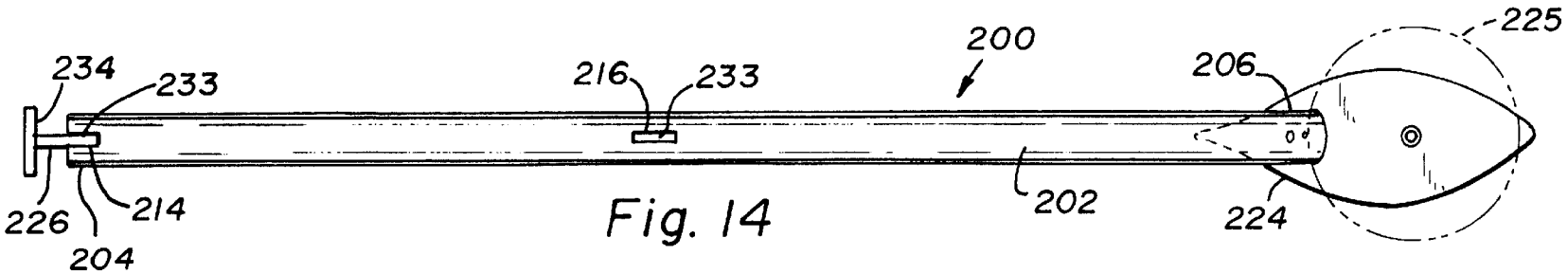
FIG. 14 is a top plan view of a secondary arm.
Figure 15:
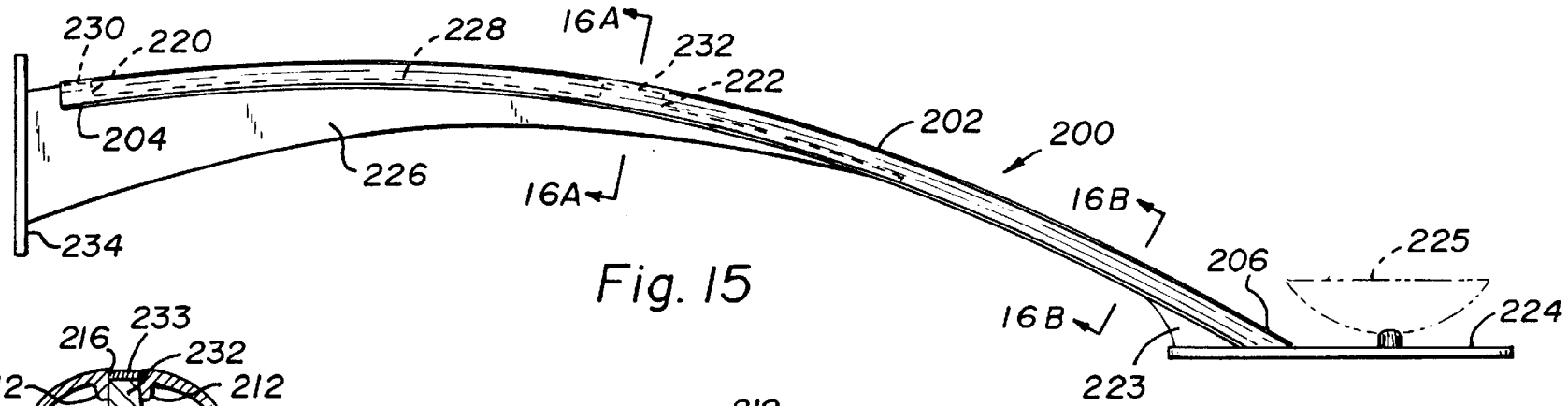
FIG. 15 is a side elevational view of the secondary arm of FIG. 14.
Figure 16B:
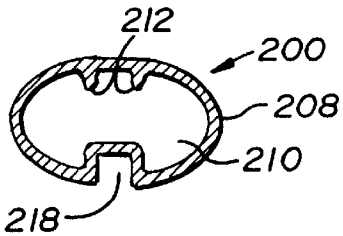
FIG. 16B is a cross-sectional view taken along lines 16B—16B of FIG. 15.
Figure 16A:
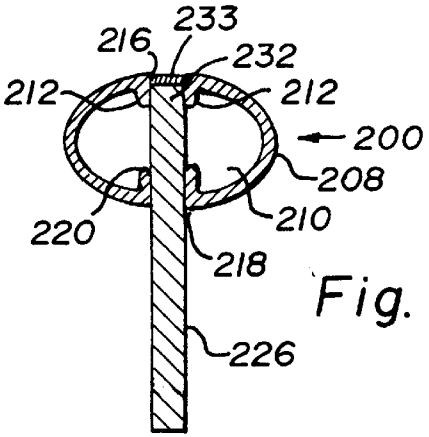
FIG. 16A is a cross-sectional view taken along lines 16A—16A of FIG. 15.

The ceiling structure 30 also includes a plurality of secondary arms 200 attached to the column member 38. As best shown in FIGS. 14–16, each secondary arm 200 includes a support arm 202 having a first end 204 and a second end 206 formed as an extrusion of aluminum. The support arm 202 includes a housing 208 forming an elongate chamber 210 therein. The housing 208 includes a pair of downwardly extending ribs 212 located within the chamber 210 that form an elongate channel therebetween. A slot 214 is formed in the top of the housing 208 at the first end 204 and a slot 216 is formed in the top of the housing 208 that is located approximately midway between the ends 204 and 206. The housing 208 also includes an external elongate channel 218 located in the bottom of the housing 208. The channel 218 includes a slot 220 aligned with the slot 214 and a slot 222 aligned with the slot 216. A platform 224 is attached to the second end 206 of the support arm 202. A gusset member 223 is attached to and extends between the support arm 202 and the platform 224.

The secondary arm 200 also includes a gusset member 226 that rigidly engages the support member 202. The gusset member 226 includes a top edge 228 that is located within the channel 218 of the housing 208. The gusset member 226 includes a tab 230 that extends through the slot 220 and into the channel between the ribs 212 and in alignment with the slot 214 of the housing 208. The gusset member 226 also includes a tab 232 that extends through the slot 222 and into the channel between the ribs 212 in alignment with the slot 216 of the housing 208. The tabs 230 and 232 are secured by welds 233 to the support arm 202 within the slots 214 and 216. A mounting plate 234 is attached to the proximal end of the gusset member 226. A light fixture 225 is mounted to the platform 224. The light fixture 225 is shown as being mounted to the top of the platform 224, but the light fixture 225 may also be mounted to the bottom of the platform 224. Electrical wires or cables may be located within and extend through the chambers 210 of the support arms 202 to provide electrical power to the light fixtures 225. One or more displays for showing graphic information may be respectively mounted to and supported by a primary arm 100 or a secondary arm 200.

Figure 11:
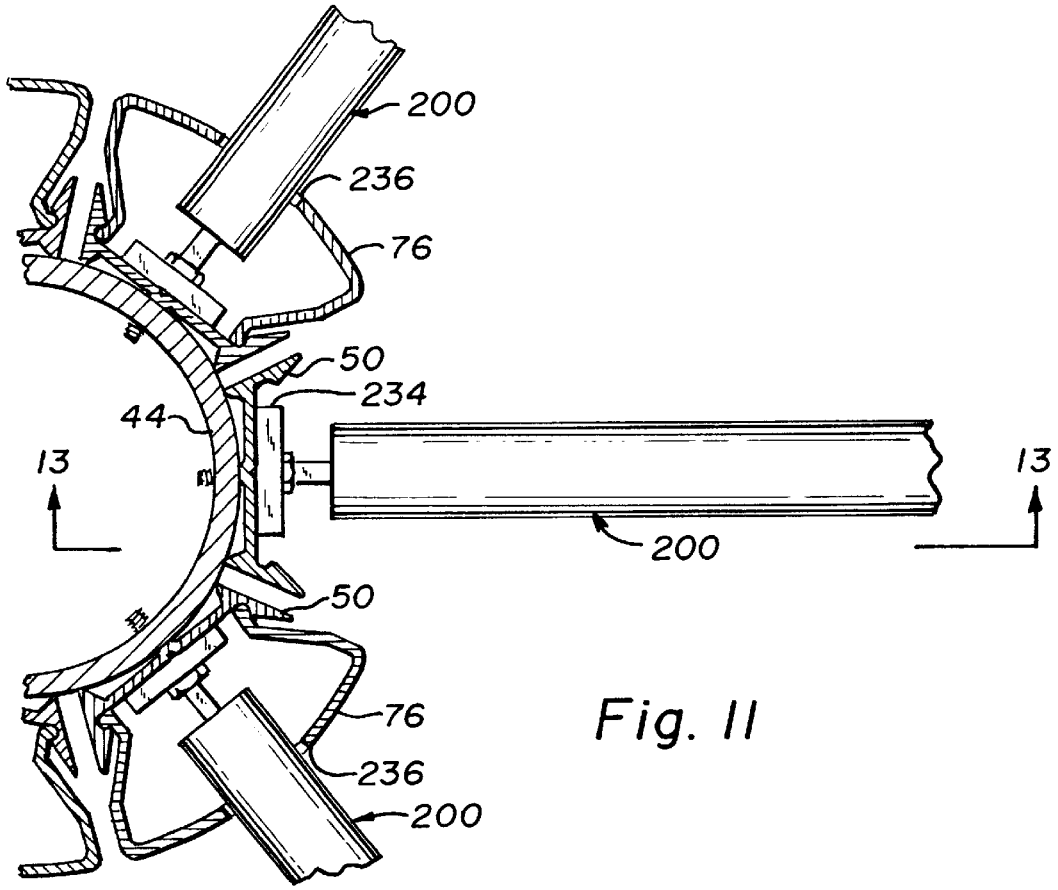
FIG. 11 is a partial cross-sectional plan view showing the connection of secondary arms to the column member.
Figure 13:
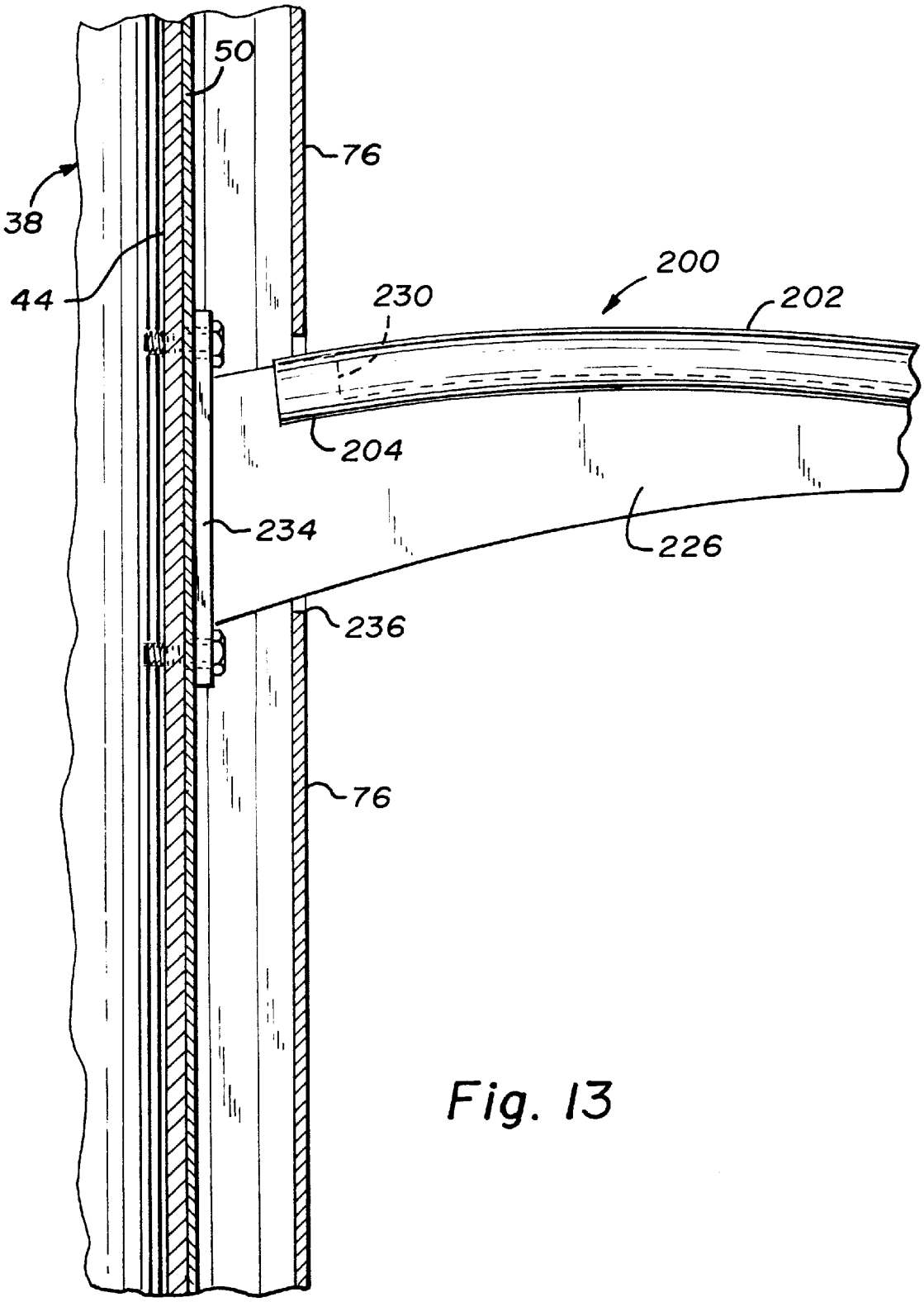
FIG. 13 is a partial cross-sectional elevational view showing the connection of a secondary arm to the column member.

As best shown in FIGS. 11 and 13, the mounting plate 234 of the secondary arm 200 is connected to a cap retainer 50 and to the support member 44 of the column member 38 by fasteners. The secondary arm 200 extends generally radially outwardly from the column member 38 through an aperture 236 in the cap member 76. The secondary arms 200 are equally spaced about the circumference of the support member 44 of the column member 38. As best shown in FIG. 2, each secondary arm 200, when viewed in plan, is located midway between two adjacent primary arms 100.

Figure 21:
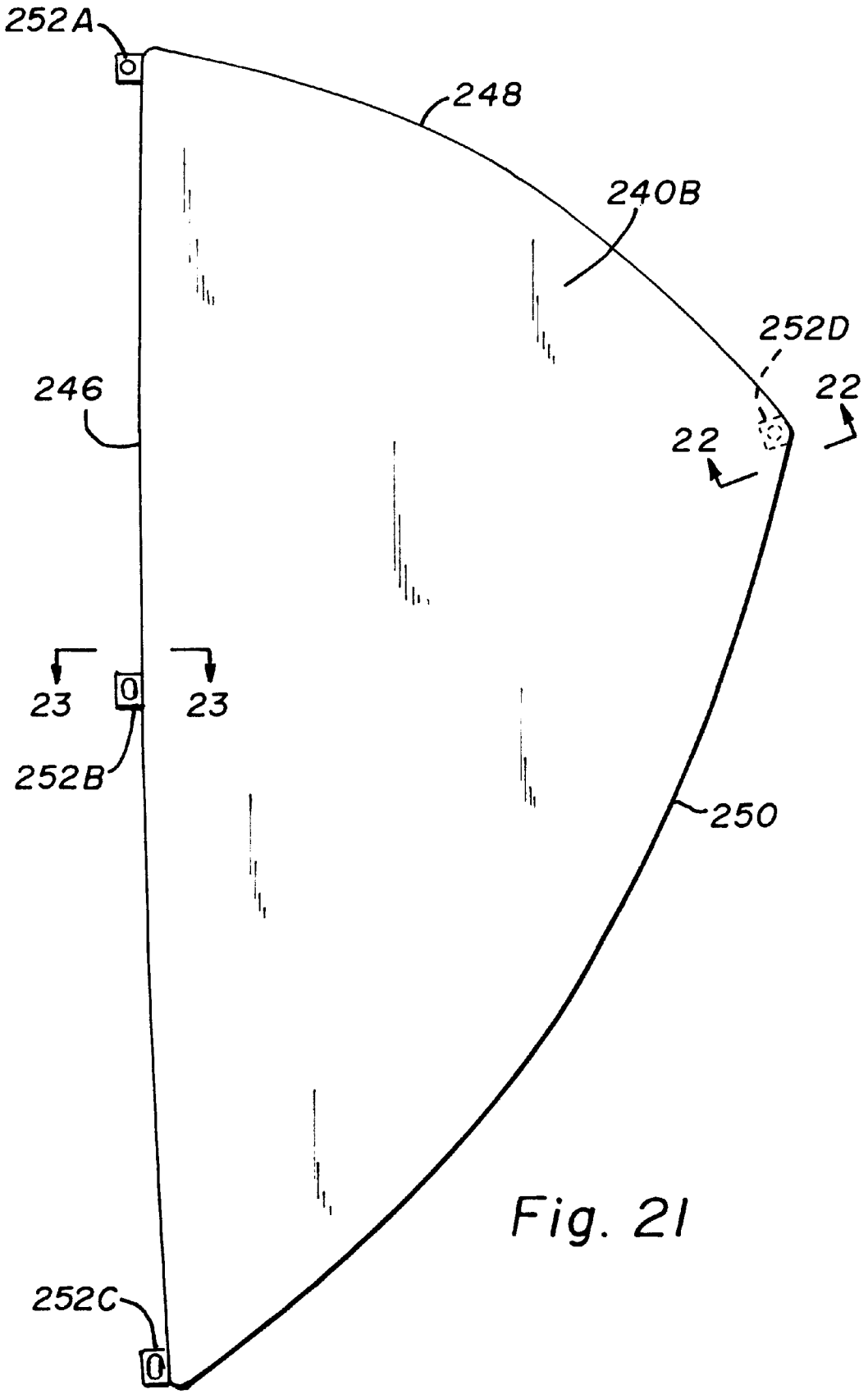
FIG. 21 is a top plan view of a panel member.
Figure 22:
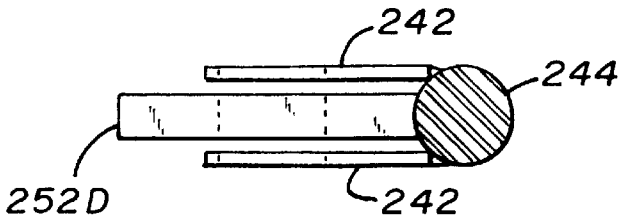
FIG. 22 is a partial cross-sectional view taken along lines 22—22 of FIG. 21.
Figure 23:
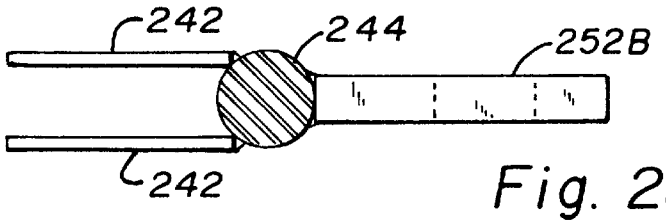
FIG. 23 is a partial cross-sectional view taken along lines 23—23 of FIG. 21.

As best shown in FIG. 2, each primary arm 100 includes peripheral panel members 240A and 240B attached thereto. In the disclosed mode of the invention, the panel member 240B, as shown in FIGS. 21–23, is formed from two sheets 242 that are disposed one above the other in a spaced relationship. Optionally, only one sheet 242 may be used to form a panel member. The sheets 242 are made from sheet metal or perforated sheet metal, but may be made from other materials such as fabric, polymeric materials, fiberglass or reinforced plastic and may be transparent, translucent or opaque and may have sound absorbing acoustically properties. The sheets 242 may be rigid, flexible, elastic or non-elastic. A metal rod 244, which may be solid or tubular, extends between the sheets 242 along the edges thereof to space the sheets 242 apart from one another and to close the edges of the panel member 240B. As shown in FIG. 21, the panel member 240B is generally triangular having a longitudinal edge 246, a distal edge 248 and a proximal edge 250. A plurality of tabs 252A–D are attached to the panel member 240B. The tabs 252A and D include circular apertures and the tabs 252B and 252C include slotted apertures. The tabs 252A–C are located externally of the sheets 242 and the tab 252D is located internally between the sheets 242.

Each panel member 240B is attached to a stanchion 140B, 142B and 144B of a primary arm 100 and to the second end 184 of the sub-arm 180B that is attached to the primary arm. The tab 252A is attached to the stanchion 140B such that the panel 240B sits on the top edge of the sleeve 150 with the fastener 148 extending through the aperture in the tab 252A. The tab 252B is similarly attached to the stanchion 142B and the tab 252C is similarly attached to the stanchion 144B. The tab 252D is attached to a stanchion or bracket (not shown) that is connected to the second end 184 of a sub-arm 180B. The sleeves 150 of the stanchions space the panel member 240B above the primary arm 100 at a first level.

Each panel member 240A is constructed in the same manner as the panel member 240B, but as a left-hand version thereof. Optionally, each respective panel member 240A may be formed as a unitary panel member with a respective panel member 240B. Each panel member 240A is attached to a stanchion 140A, 142A and 144A of a primary arm 100 and to a stanchion or bracket (not shown) that is connected to the second end 184 of the sub-arm 180A that is attached to the primary arm 100. The sleeves 150 of the stanchions space the panel member 240A above the primary arm 100 symmetrically with the panel member 240B. Optionally, the sub-arms 180A-B may be eliminated and the panel members 240A–B may cantilever outwardly from each side of the primary arms 100. Alternatively, more than one sub-arm 180A or B may extend from the primary arms 100 to be attached to a panel member 240A or B, respectively.

Figure 24:
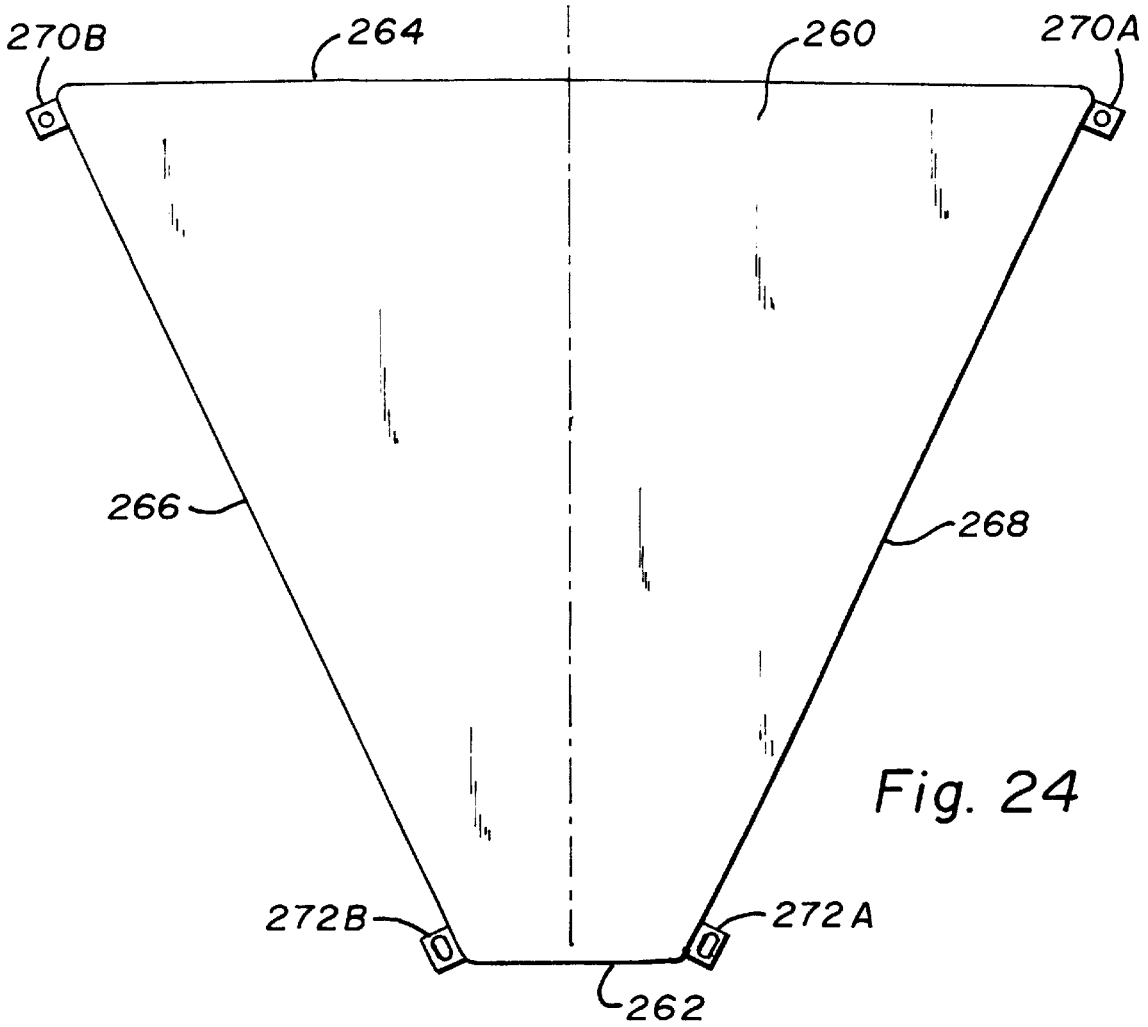
FIG. 24 is a top plan view of a canopy member.

The ceiling structure 30 also includes a plurality of central canopy members 260. As shown in FIG. 24, each canopy member 260 is generally formed in the shape of a trapezoid. The canopy members 260 of the disclosed embodiment are formed in the same general manner and with the same types of materials as the panel members 240A–B, preferably with two sheets of material spaced apart from one another by a peripheral rod. The canopy member 260 includes a proximal edge 262, an opposing distal edge 264, and two opposing side edges 266 and 268. The canopy member 260 includes tabs 270A–B, each of which includes a circular aperture. The canopy member 260 also includes tabs 272A–B, each of which includes a slotted aperture.

Each canopy member 260 is attached to a first primary arm 100 by the stanchions 142B and 146B thereof and to an adjacent primary arm 100 by the stanchions 142A and 146A thereof. The tab 272B is attached to the stanchion 146B and the tab 270B is attached to the stanchion 142B of a first primary arm member 100. The tab 272A is attached to the stanchion 146A and the tab 270A is attached to the stanchion 142A of a second adjacent primary arm 100. The tabs 270A and B are seated on top of the sleeves 154 of the stanchions 142A–B. The tabs 272A–B are similarly seated on top of the sleeves 152 of the stanchions 146A–B. The sleeves 152 and 154 of the stanchions space the canopy members 260 above the primary arms 100 at a second level that is spaced above the first level of the panel members 240A–B.

Each canopy member 260 extends from the column member 38 and between two adjacent primary arms 100 such that each canopy member 260 overlaps with the panel member 240A of one primary arm 100 and the panel member 240B of a second adjacent primary arm 100. As shown in FIG. 2, the panel members 240A–B project outwardly beyond the distal edges 264 of the canopy members 260. If desired, sound insulating material such as fiberglass may be placed on the surfaces of the panel members 240A–B and the canopy members 260. Optionally, all of the panel members 240A–B may be formed as one unitary panel member. In addition, all of the canopy members 260 may be formed as one unitary canopy member. Alternatively, all of the panel members 240A–B and all of the canopy members 260 may be formed as one unitary panel member. These unitary panel and canopy members may be flat or formed with various bends and contours.

Figure 25:
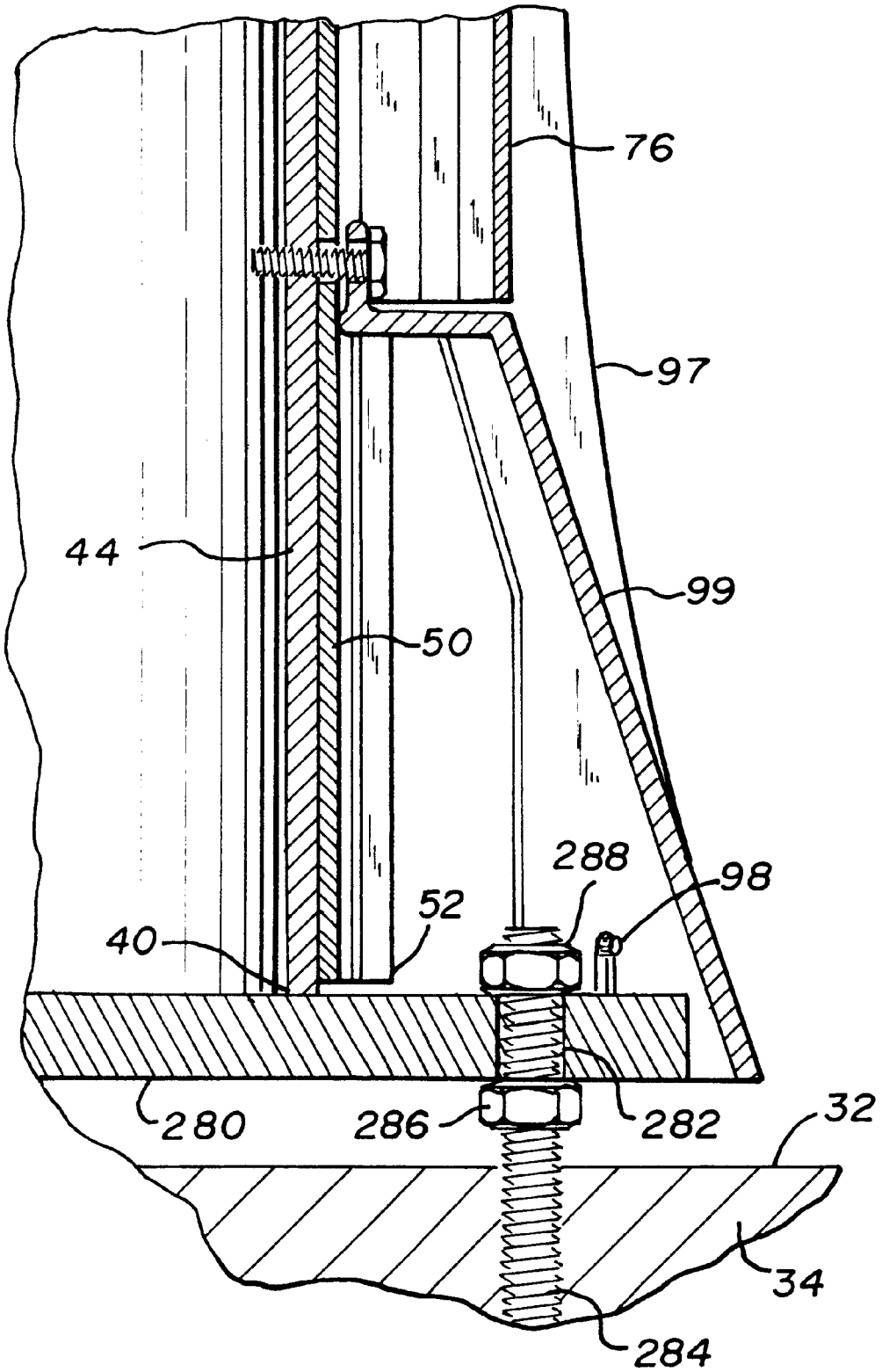
FIG. 25 is a partial cross-sectional view of an alternate embodiment of the base of the column member.

FIG. 25 shows an alternate construction of the base of the column member 38. A flange plate 280 is welded to the bottom end 40 of the support member 44. The flange plate 280 includes a plurality of apertures 282. An anchor bolt 284 extends through each aperture 282. Each anchor bolt 284 includes a leveling nut 286 on which the flange plate 280 rests. The leveling nuts 286 space the flange plate 280 above the floor surface 32 and permit leveling of the flange plate 280. A lock nut 288 is attached to each anchor bolt 284 above the flange plate 280 to secure the flange plate 280 and the support member 44 to the floor 34. The base caps 99 enclose the flange plate 280 and the locking nuts 288. The space between the flange plate 280 and the floor 34 may be grouped if desired after leveling of the flange plate 280. As shown in FIG. 24, the flange plate 280 extends beyond the support member 44 to provide additional stability to the ceiling structure 30 when the ceiling structure 30 requires additional stability due to its size and weight.

In one embodiment of the ceiling structure 30, the support member 44 is formed from a circular tube having a five inch outer diameter, a one-quarter inch wall thickness, and a length of twelve feet. The cap members 76 are approximately 3.5 inches wide by approximately 1.9 inches deep and may be various lengths as desired. The cap members 76, if desired, may extend from the floor 34 to the hub covers 174. The support member 106 of the primary arm 100 is approximately 104 inches long and the housing 112 is approximately 2.4 inches high by approximately 3.7 inches wide. The primary arms 100 are located on the support member 44 of the column member 38 such that the top of the housing 112 is located approximately 114 inches above the support surface 32. Thereby the free-standing ceiling structure 30 provides a large social gathering space there below, approximately eighteen feet in diameter, and approximately 110 inches to 116 inches in height from the floor 34 to the panel members 240A–B and canopy members 260.

The support arm 202 of the secondary arm 200 is approximately 40 inches long and the housing 208 is approximately 1 inch high by approximately 1.5 inches wide. The secondary arms 200 are positioned on the support member 44 of the column member 38 such that the platforms 224 are located approximately 85 inches above the support surface 32. The panel members 240A–B have a length of approximately 75 inches along the longitudinal edge 246 and a width of approximately 38 inches. The canopy members 260 have a width of approximately 11 inches at the proximal edge 262, a width of approximately 55 inches at the distal edge 264 and a length of approximately 46 inches between the proximal edge 262 and the distal edge 264. Various other sizes and dimensions of the components that form the ceiling structure 30 may be used as desired.

Alternatively, the primary arms 100 and secondary arms 200 may be attached to a vertical supporting member such as a wall, as opposed to a free-standing column, such that the panel members 240A–B and canopy members 260 generally form a 180° half-circle when viewed in plan. The arms 100 and 120 may also be attached to a vertical supporting wall at a corner thereof such that the panel members 240A–B and canopy members 260 generally form a 90° quarter-circle when viewed in plan.

If desired, the ceiling structure 30 can be provided with an upper extension (not shown) that is connected to the top end 42 of the support member 44 and that is adapted to be attached to a structure (not shown) located above the ceiling structure 30 to provide additional support to the ceiling structure 30.

Various features of the invention have been particularly shown and described in connection with the illustrated embodiment of the invention, however, it must be understood that these particular arrangements merely illustrate, and that the invention is to be given its fullest interpretation within the terms of the appended claims.

What is claimed is:

1. A free-standing, non-collapsible ceiling structure comprising:

an elongate column member having a bottom end and a top end and a central longitudinal axis;

a plurality of cantilevered primary arms supported by said column member, each said primary arm including a proximal end rigidly affixed to said column member and a non-affixed cantilevered distal end, said plurality of primary arms being spaced around said column member and extending generally radially from said column member;

at least one panel member; and a plurality of support means for supporting said at least one panel member, each of said support means fixedly attached to only one of said primary arms.

2. The free-standing, non-collapsible ceiling structure of claim 1 wherein said plurality of support means comprise means for spacing said at least one panel member from said primary arms.

3. The free-standing, non-collapsible ceiling structure of claim 1 wherein said plurality of support means comprise a plurality of first sub-arms, each said first sub-arm being attached to one of said primary arms, each said first sub-arm including a first end attached to said one primary arm and a second end spaced apart from said one primary arm, and a plurality of second sub-arms, each said second sub-arm being attached to one of said primary arms, each said second sub-arm including a first end attached to said one primary arm and a second end spaced apart from said one primary arm.

4. The free-standing, non-collapsible ceiling structure of claim 3 wherein each said at least one panel member is attached to said distal end of one of said primary arms and to said second end of one of said first and second sub-arms attached to said one primary arm.

5. The free-standing, non-collapsible ceiling structure of claim 1 including a plurality of secondary arms supported by said column member, said secondary arms located between said bottom end of said column member and said plurality of primary arms, each said secondary arm including a proximal end attached to said column member and a distal end, said secondary arms being spaced apart from one another around said column member and extending generally radially outwardly from said column member.

6. The free-standing, non-collapsible ceiling structure of claim 5 including a plurality of lighting means for projecting light, each said lighting means being attached to said distal end of one of said secondary arms.

7. The free-standing, non-collapsible ceiling structure of claim 5 including a plurality of display means for displaying graphic information, each said display means being supported by one of said primary arms or one of said secondary arms.

8. The free-standing, non-collapsible ceiling structure of claim 1 including a base member attached to said bottom end of said column member for rigidly attaching said column member to a support surface.

9. The free-standing, non-collapsible ceiling stricture of claim 1 wherein said column member includes a utility device.

10. A free-standing, non-collapsible ceiling structure comprising:

an elongate column member having a bottom end and a top end and a central longitudinal axis;

a plurality of cantilevered primary arms supported by said column member, each said primary arm including a proximal end rigidly affixed to said column member and a non-affixed cantilevered distal end, said plurality of primary arms being spaced around said column member and extending generally radially from said column member;

at least one panel member;

a plurality of support means each being fixedly attached to only one of said primary arms for supporting said at least one panel member, said at least one panel member being supported by said support means;

a plurality of secondary arms supported by said column member, said secondary arms located between said bottom end of said column member and said plurality of primary arms, each said secondary arm including a proximal end attached to said column member and a distal end, said secondary arms being spaced apart from one another around said column member and extending generally radially outwardly from said column member; and each said secondary arm including an elongate chamber.

11. A free-standing, non-collapsible ceiling structure comprising:

an elongate column member having a perimeter, a bottom end and a top end and a central longitudinal axis;

a plurality of cantilevered primary arms supported by said column member, each said primary arm including a proximal end rigidly affixed to said column member and a non-affixed cantilevered distal end, said plurality of primary arms being spaced around said column member and extending generally radially from said column member;

at least one panel member;

a plurality of support means fixedly attached to said primary arms for supporting said at least one panel member, said at least one panel member being supported by said support means; and a plurality of retainers located around the perimeter of said column member and a plurality of cap members, each said cap member being selectively attached to one of said retainers, whereby said cap members can be selectively removed from said retainers.

12. The free-standing, non-collapsible ceiling structure of claim 11 including a plurality of elongate channels, each said channel being formed between one of said cap members and one of said retainers.

13. The free-standing, non-collapsible ceiling structure of claim 11 wherein each said retainer includes a web and two spaced apart flanges extending radially outwardly from said web.

14. The free-standing, non-collapsible ceiling structure of claim 13 wherein each said flange of each said retainer includes a notch and each said cap member includes a pair of spaced apart ribs, each said rib adapted to intermit with one of said notches to releasable attach said cap member to said retainer.

15. The free-standing, non-collapsible ceiling structure of claim 13 including a plurality of secondary arms each having a proximal end and a distal end, wherein said proximal end of each said secondary arm is attached to said web of one of said retainers.

16. The free-standing, non-collapsible ceiling structure of claim 11 wherein said retainers are elongate and extend along said column member generally parallel to one another and to said central longitudinal axis of said column member.

17. A free-standing, non-collapsible ceiling structure comprising:

an elongate column member having a bottom end and a top end and a central longitudinal axis;

a plurality of cantilevered primary arms supported by said column member, each said primary arm including a proximal end rigidly affixed to said column member and a non-affixed cantilevered distal end, said plurality of primary arms being spaced around said column member and extending generally radially from said column member;

at least one canopy member; and a plurality of support means for supporting said at least one canopy member, each of said support means fixedly attached to only one of said primary arms.

18. The free-standing, non-collapsible ceiling structure of claim 17 wherein said plurality of support means comprise means for spacing said at least one canopy member from said primary arms.

19. A free-standing, non-collapsible ceiling structure comprising:

an elongate column member having a bottom end and a top end and a central longitudinal axis;

a plurality of cantilevered primary arms supported by said column member, each said primary arm including a proximal end rigidly affixed to said column member and a non-affixed cantilevered distal end, said plurality of primary arms being spaced around said column member and extending generally radially from said column member;

a plurality of first sub-arms, each said first sub-arm being attached to one of said primary arms, each said first sub-arm including a first end attached to said one primary arm and a second end spaced apart from said one primary arm, and a plurality of second sub-arms, each said second sub-arm being attached to one of said primary arms, each said second sub-arm including a first end attached to said one primary arm and a second end spaced apart from said one primary arm; and a plurality of panel members including at least one first panel member and at least one second panel member, said at least one first panel member being attached to said distal end of one of said primary arms and to said second end of said first sub-arm of said one primary arm, said at least one second panel member being attached to said distal end of one of said primary arms and to said second end of said second sub-arm of said one primary arm.

20. The free-standing, non-collapsible ceiling structure of claim 19, further comprising a plurality of canopy members attached to and supported by said plurality of primary arms, said canopy members being located around said central longitudinal axis of said column member, each of said canopy members being disposed over at least one of said panel members, with each said panel member projecting outwardly beyond at least one of said canopy members.

* * * * *